US005147769A

United States Patent [19]

Toya et al.

[11] Patent Number: 5,147,769

[45] Date of Patent: Sep. 15, 1992

[54] X-RAY PHOTOGRAPHIC MATERIAL

[75] Inventors: Ichizo Toya; Yoshihiro Jimbo, both of Kanagawa, Japan

[73] Assignee: Fuji Photo Film Co., Ltd., Kanagawa, Japan

[21] Appl. No.: 533,542

[22] Filed: Jun. 5, 1990

[30] Foreign Application Priority Data

Jun. 5, 1989 [JP] Japan ..... 1-142688
Oct. 23, 1989 [JP] Japan ..... 1-275551

[51] Int. Cl.[5] ..... G03C 1/46

[52] U.S. Cl. ..... 430/496; 430/502; 430/580; 430/592; 430/594; 430/966

[58] Field of Search ..... 430/139, 502, 546, 580, 430/592, 594, 466, 966, 496

[56] References Cited

U.S. PATENT DOCUMENTS

| | | | |
|---|---|---|---|
| 4,239,851 | 12/1980 | Aoki et al. | 430/377 |
| 4,278,757 | 7/1981 | Mukunoki et al. | 430/512 |
| 4,420,555 | 12/1983 | Krueger et al. . | |
| 4,764,455 | 8/1988 | Arakawa et al. . | |
| 4,900,652 | 2/1990 | Dickerson et al. | 430/502 |
| 4,923,783 | 5/1990 | Kobayashi et al. | 430/377 |
| 4,977,750 | 3/1991 | Dickerson et al. | 430/509 |

FOREIGN PATENT DOCUMENTS

| | | | |
|---|---|---|---|
| 0274723 | 7/1988 | European Pat. Off. . | |
| 0276566 | 8/1988 | European Pat. Off. . | |
| 0323728 | 7/1989 | European Pat. Off. . | |
| 2-264936 | 10/1990 | Japan | 430/966 |

*Primary Examiner*—Hoa Van Le
*Assistant Examiner*—Janet C. Baxter
*Attorney, Agent, or Firm*—Sughrue, Mion, Zinn, Macpeak & Seas

[57] ABSTRACT

An X-ray photographic material having:

(1) at least one sensitive silver halide photographic emulsion layer provided on both sides of a support; and (2) at least one layer provided on at least one side of the support for fixing a dye which can be decolorized during development and which absorbs light in the sensitive region of the photographic material and wherein:

(3) the dye contributes to the reduction of cross-over to less than 10%; and (4) the dye is a compound selected from the group consisting of compounds represented by the following general formula (I) and is dissolved in an oil which is a solvent substantially insoluble in water and having a boiling point of not lower than 160° C. and which is dispersed as oil droplets or is loaded and dispersed in a polymer latex:

(I)

wherein X and Y each represents a substituent group, or X and Y may be combined together to form a heterocyclic ring $L^1$, $L^2$ and $L^3$ each represents a methine group; R and R' each represents a hydrogen atom or a substituent group; m represents an integer of from 1 to 4; and n represents 0 or 1.

5 Claims, No Drawings

X-RAY PHOTOGRAPHIC MATERIAL

FIELD OF THE INVENTION

The present invention relates to a silver halide photographic material. More particularly, it relates to a photographic material having improved image quality (particularly sharpness) in medical image forming methods (particularly methods using X-rays), and which can cope with rapid processing and can be stably prepared in that the material does not suffer surface artifact caused by agglomerates and the labor associated with filter exchange to remove agglomerates may be eliminated.

BACKGROUND OF THE INVENTION

In recent years it has been desired to provide photographic materials which give images having high sharpness and which can be processed rapidly (in less than 90 seconds) to facilitate accurate and rapid diagnoses in the field of medicine.

With regard to sharpness, there have been proposed methods wherein an improvement in sharpness depends on the amount of light absorbed by spectral sensitizing dyes which in large quantities are adsorbed by silver halide grains having a large specific area and a high aspect ratio (ratio of the average diameter of circles equivalent to the projected areas of grains to the thickness of grain) in an ortho-system (a system consisting of a combination of a rare earth element intensifying screen such as $Gd_2O_2S$ with an ortho-photographic material having sensitivity in the green region). JP-A-1-126645 discloses a method for improving sharpness wherein there are used photographic materials containing dyes absorbing light in the sensitive region thereof, dyes being deposited on mordants.

However, when high sharpness (cross-over of less than 10%) is attained in these methods, a problem of residual dye occurs when processing is carried out in less than 90 seconds A method wherein cross-over is made less than 10% by using dyes in the form of crystalline grains has recently been disclosed in EPO 276566A1. The problems of sharpness and residual dye in 90-second processing can be solved by this method. However, a problem of residual dye in 45-second processing occurs. When dyes are allowed to exist in the form of fine crystalline grains, the amount of binders will be increased. (When the amount of the binders is reduced, surface artifact is caused and the correctness of diagnoses is greatly reduced.) Further, when the amount of the binder is increased, the possibility of forming agglomerates is increased and surface damage is liable to occur. Methods for removing agglomerates with filters have been proposed to solve the problem. However, these methods have a serious problem in the handling of the photographic materials during the course of production.

Accordingly, it has been desired to provide a method wherein dyes are incorporated in dye-fixing layers without forming cryatalline grains or agglomerates.

SUMMARY OF THE INVENTION

An object of the present invention is to provide a medical photographic material which can be stably produced, give an image having greatly improved sharpness, and be processed rapidly.

The above-described object of the present invention has been achieved by providing an X-ray photographic material having:

(1) At least one sensitive silver halide photographic emulsion layer provided on both sides of a support;

(2) At least one layer provided on at least one side of the support for fixing a dye which can be decolorized during processing and which absorbs light in the sensitive region; and wherein (3) The dye contributes to the reduction of cross-over to less than 10%; and (4) The dye is a compound selected from the group consisting of compounds represented by the following general formula (I) and is dissolved in an oil which is a solvent substantially insoluble in water and having a boiling point of not lower than 160° C. and which is dispersed as oil droplets or is loaded and dispersed in a polymer latex:

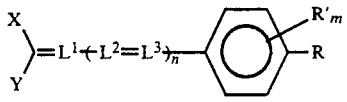

(I)

wherein X and Y each represents a substituent group, or X and Y may be combined together to form a heterocyclic group; $L^1$, $L^2$ and $L^3$ each represents a methine group; R and R' each represents a hydrogen atom or a substituent group; m represents an integer of from 1 to 4; and n represents 0 or 1.

DETAILED DESCRIPTION OF THE INVENTION

The compounds of formula (I) will be described in more detail below.

X and Y are each a substituent group, preferably an electron attractive group (e.g., a cyano group, a carboxyl group, an alkylcarbonyl group (e.g., acetyl, propionyl, heptanoyl, dodecanoyl, hexadecanoyl, 1-oxo-7-chloroheptyl), an arylcarbonyl group (e.g., benzoyl, 4-aminobenzoyl, 4-methanesulfonylaminobenzoyl, 4-ethanesulfonylaminobenzoyl), an alkoxycarbonyl group (e.g., methoxycarbonyl, ethoxycarbonyl, t-amyloxycarbonyl, 2-hydroxyethoxycarbonyl), an aryloxycarbonyl group (e.g., phenoxycarbonyl, 4-methoxyphenoxycarbonyl), a carbamoyl group (e.g., carbamoyl, N-ethylcarbamoyl, N,N-dimethylcarbamoyl, 4-methoxyphenylcarbamoyl), a sulfonyl group (e.g., methylsulfonyl, ethylsulfonyl, phenylsulfonyl), a sulfamoyl group (e.g., sulfamoyl, methylsulfamoyl)), or X and Y may be combined together to form a heterocyclic group, preferably a 5-membered heterocyclic group (e.g., 2-pyrazolin-5-one-4-ylidene, pyrazolidine-3,5-dion-4-ylidene, 4,5-dihydroisoxazol-5-one-4-ylidene) or a 6-membered heterocyclic group (e.g., 1,2-dihydro-6-hydroxypyridin-2-one-3-ylidene, hexahydropyrimidine-2,4,6-trion-5-ylidene); $L^1$, $L^2$ and $L^3$ are each a methine group (preferably an unsubstituted methine group, but may be substituted by a substituent group such as a methyl group or an ethyl group); R is hydrogen atom or a substituent group, preferably an electron donative group e.g., a hydroxyl group, an alkoxy group (e.g., methoxy, ethoxy, 2-hydroxyethoxy, butoxy), a phenoxy group (e.g., phenoxy, 4-methoxyphenoxy), an amino group (e.g., N,N-dimethylamino, N,N-diethylamino, N-ethyl-N-(2-methanesulfonamidoethyl)amino, N,N bis(2-methoxycarbonylmethyl)amino, N,N -bis(2-propoxycarbonylmethyl)amino, N-ethyl-N-carboxymethylamino); R′ is a hydrogen atom or a substituent group, preferably an alkyl group (e.g., methyl, ethyl, 2-ethylhexyl, cyclohexyl), an aryl group (e.g., phenyl, 4-methoxyphenyl), a halogen atom (e.g., chlorine, bromine), a hydroxyl group, a cyano group, a nitro group, an alkoxy group (e.g., methoxy, ethoxy, methylenedioxy), an amino group (e.g., acetylamino, methanesulfonylamino, methylamino, diethylamino), a carbamoyl group (e.g., carbamoyl, methylcarbamoyl), or a sulfamoyl group (e.g., sulfamoyl, methylsulfamoyl); m is an integer of 1 to 4; and n is 0 or 1.

Examples of the compounds which can be used in the present invention include, but are not limited to, the following compounds.

I-1

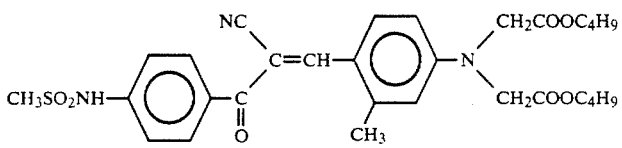

I-2

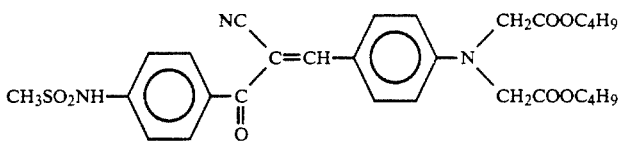

I-3

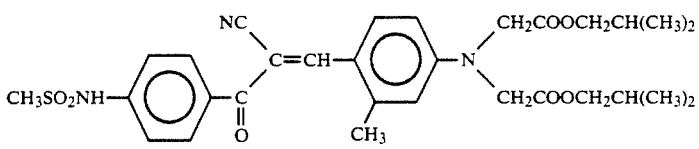

I-4

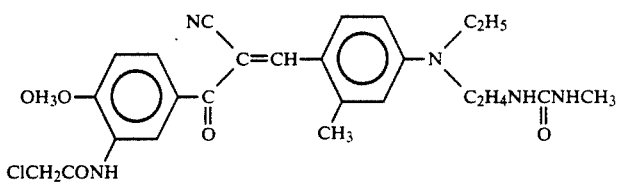

I-5

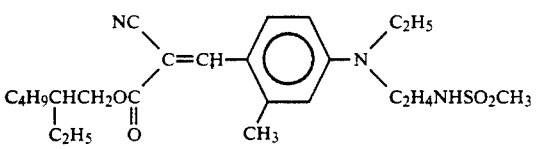

I-6

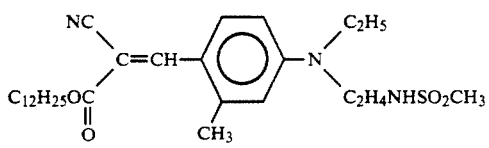

I-7

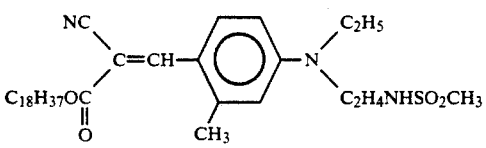

I-8

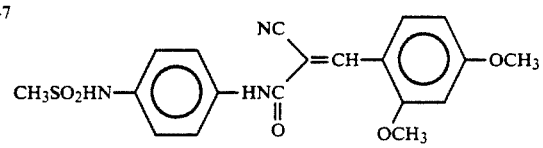

I-9

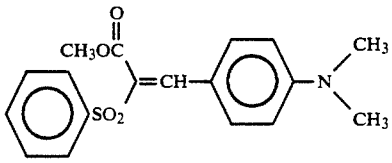

I-10

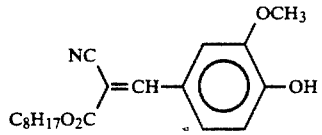

I-11

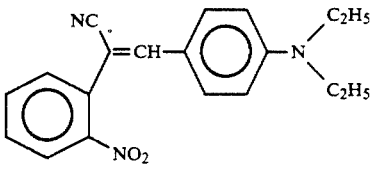

I-12

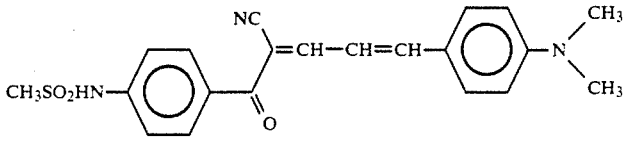

-continued
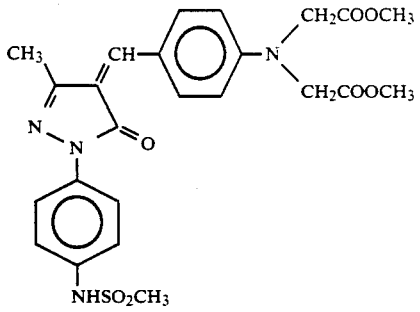
I-13
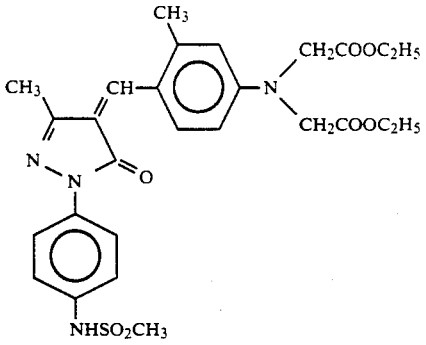
I-14
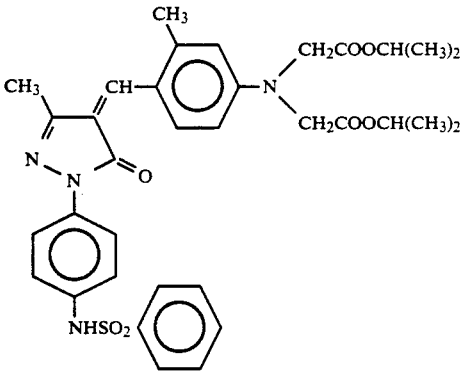
I-15
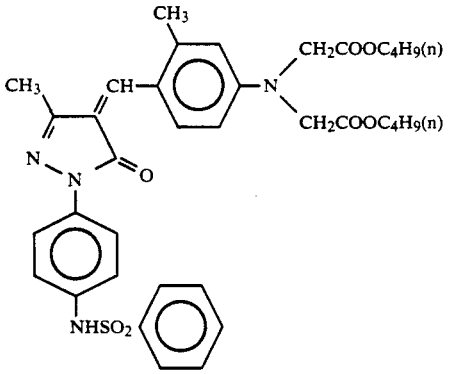
I-16
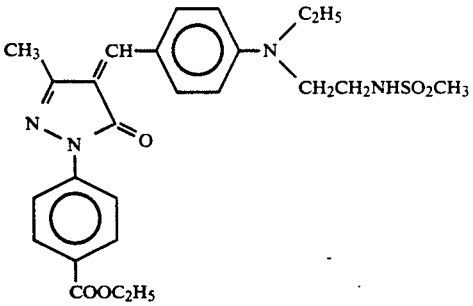
I-17
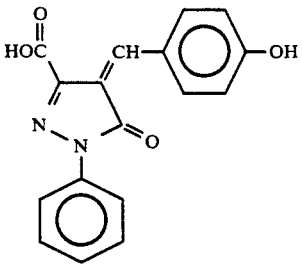
I-18
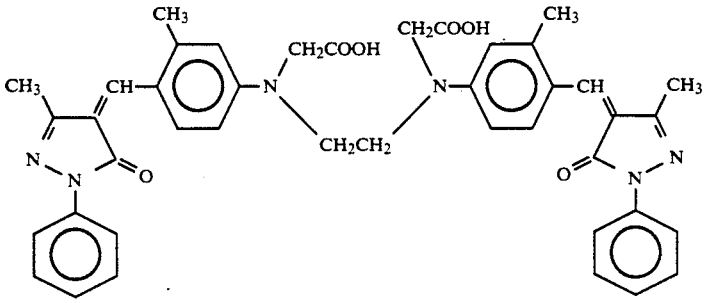
I-19

-continued
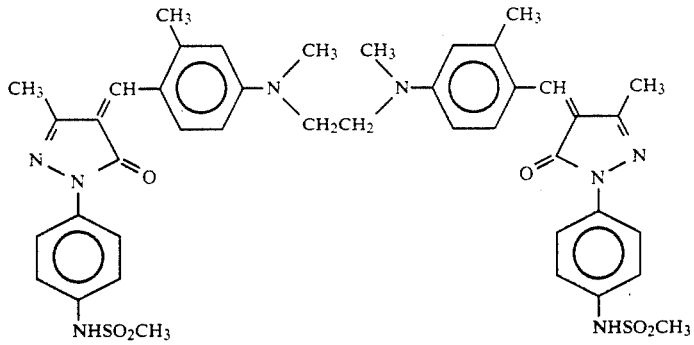
I-20
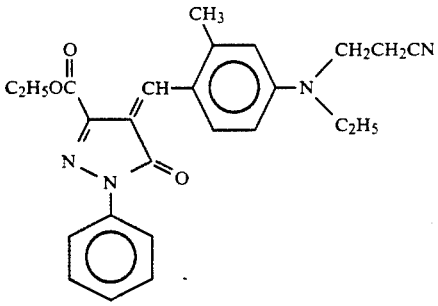
I-21
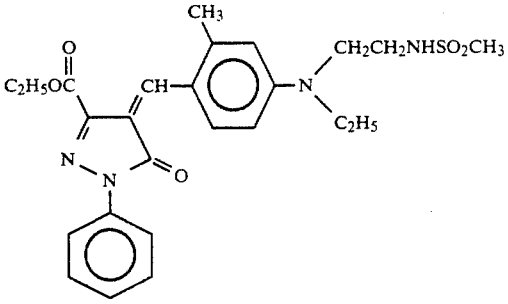
I-22
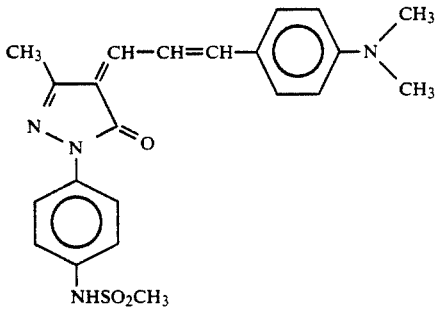
I-23
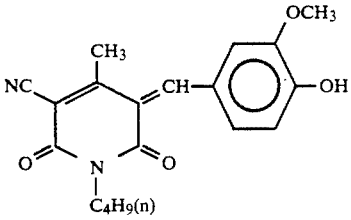
I-24
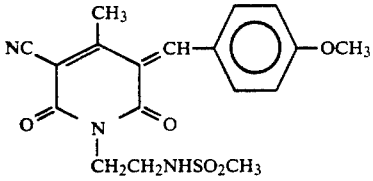
I-25
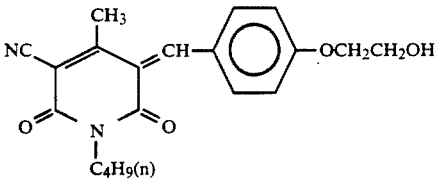
I-26
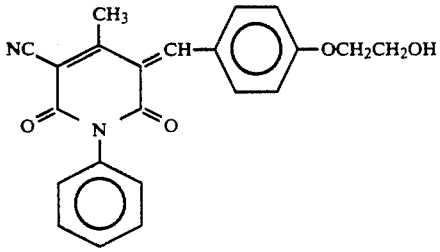
I-27
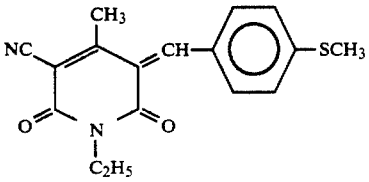
I-28
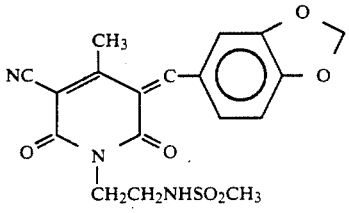
I-29
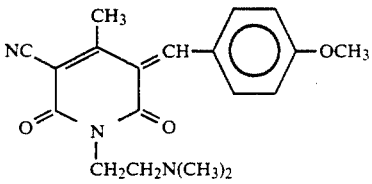
I-30

-continued
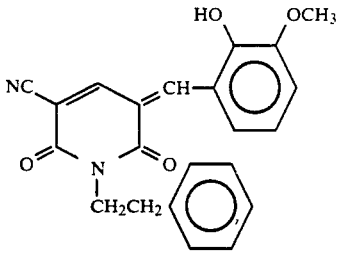
I-31
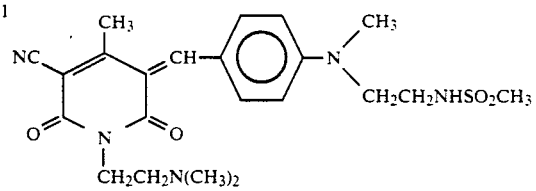
I-32
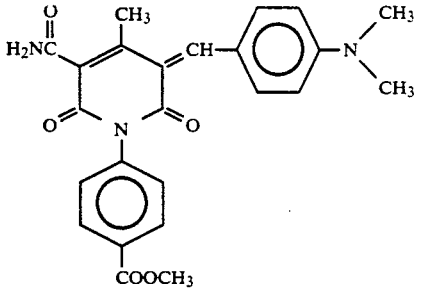
I-33
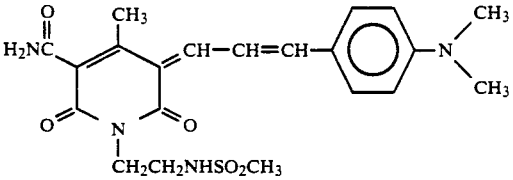
I-34
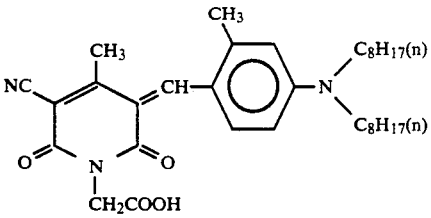
I-35
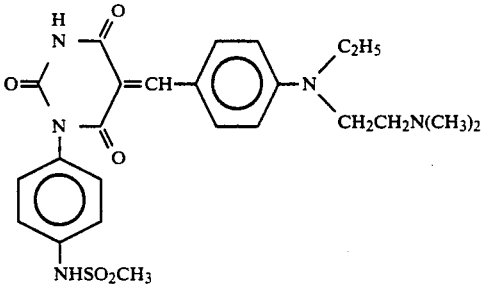
I-36
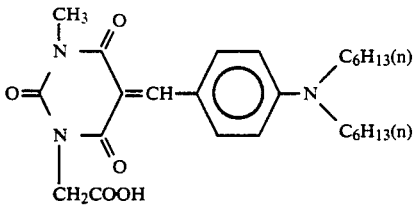
I-37
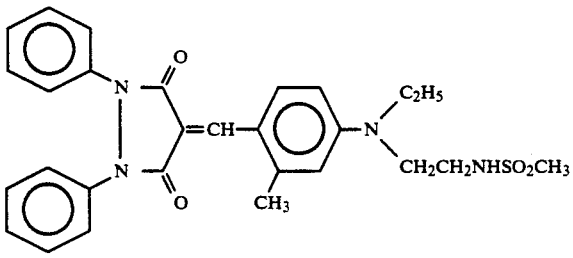
I-38
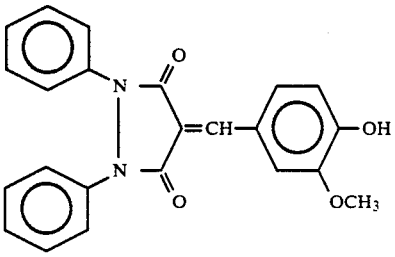
I-39
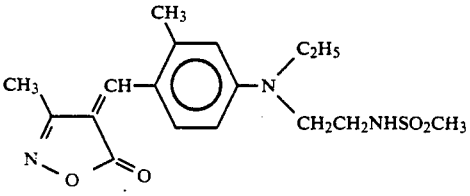
I-40

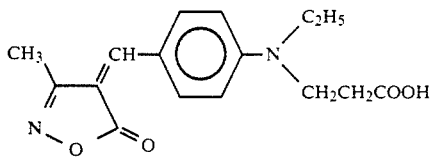

-continued

I-41

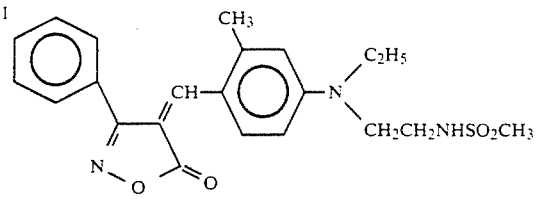

I-42

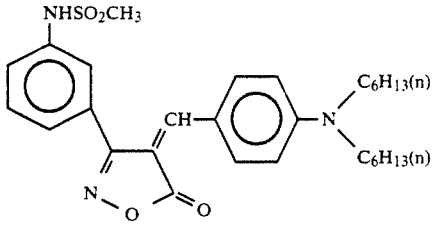

I-43

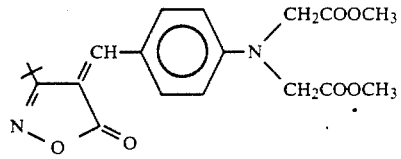

I-44

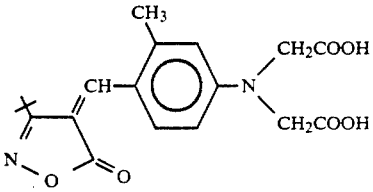

I-45

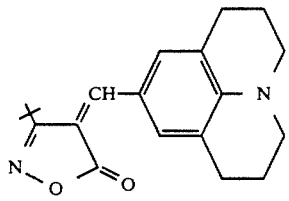

I-46

The compounds of formula (I) can be synthesized according to the methods described in U.S. Pat. No. 4,420,555, JP-A-62-222248 (the term "JP-A" as used herein means an "unexamined published Japanese patent application"), JP-A-60-64346, JP-A-63-197943, JP-A-55-155351 and European Patent 274723.

λmax of some of the compounds exemplified above are as follows.

| | |
|---|---|
| I-1 | 426 nm |
| I-8 | 371 nm |
| I-9 | 387 nm |
| I-10 | 364 nm |
| I-11 | 402 nm |
| I-15 | 436 nm |
| I-18 | 379 nm |
| I-21 | 533 nm |
| I-23 | 540 nm |
| I-24 | 450 nm |
| I-25 | 421 nm |
| I-32 | 530 nm |
| I-33 | 488 nm |
| I-34 | 528 nm |
| I-36 | 482 nm |
| I-38 | 486 nm |
| I-40 | 476 nm |

High-boiling organic solvents which are used as the oil in the present invention are preferably compounds represented by the following formulas (A) to (D):

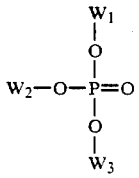

(A)

$W_1—COO—W_2$ (B)

-continued

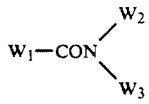

(C)

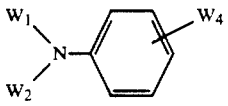

(D)

$W_1—O—W_2$ (E)

In the above formulas, $W_1$, $W_2$ and $W_3$ are each a substituted or unsubstituted alkl group , cycoalkyl group, alkenyl group, aryl group or heterocyclic group; $W_4$ is $W_1$, $OW_1$ or $SO_1$; and n is an integer of from 1 to 5. When n is 2 or greater, $W_4$ may be the same or different groups. In the formula (E), $W_1$ and $W_2$ may be combined together to form a condensed ring.

The high-boiling organic solvents are described in JP-A-62-215272 (page 137 lower right column to page 144 upper right column) in more detail.

Examples of the oils which may be used in the present invention include, but are not limited to, the following compounds.

$O=P(OC_4H_{9-n})_3$ (S-1)

$O=P(OCH_2CH_2CH(CH_3)_3)_3$ (S-2)

$O=P(OC_6H_{13-n})_3$ (S-3)

(S-4)

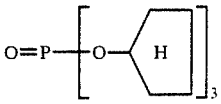

-continued
(S-5)
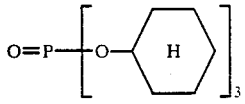
(S-6)
$O{=}P(OC_8H_{17}\text{-}\underline{n})_3$
(S-7)
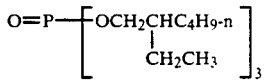
(S-8)
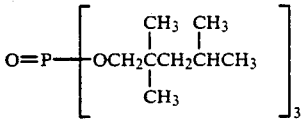
(S-9)
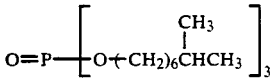
(S-10)
$O{=}P(OC_9H_{19}\text{-}\underline{n})_3$
(S-11)
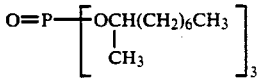
(S-12)
$O{=}P(OC_{10}H_{21}\text{-}\underline{n})_3$
(S-13)
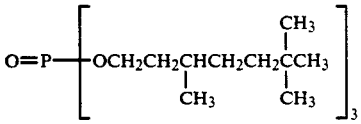
(S-14)
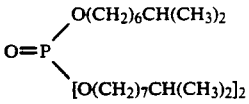
(S-15)
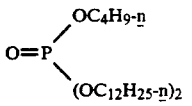
(S-16)
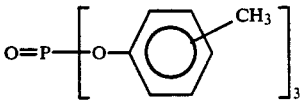
(S-17)
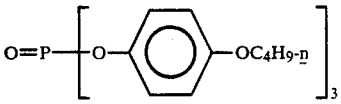
(S-18)
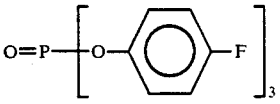
-continued
(S-19)
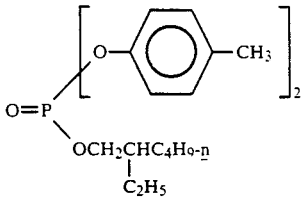
(S-20)
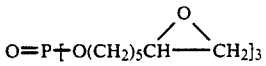
(S-21)
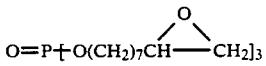
(S-22)
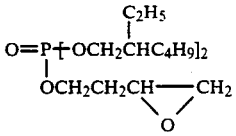
(S-23)
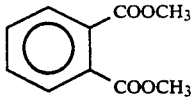
(S-24)
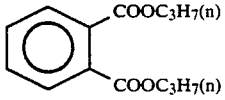
(S-25)
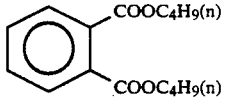
(S-26)
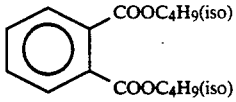
(S-27)
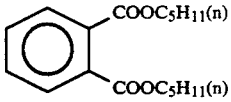
(S-28)
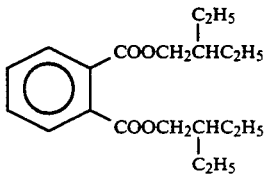
(S-29)
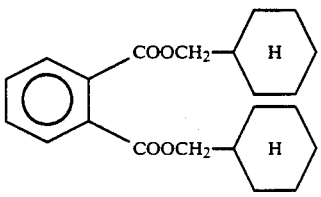

-continued
(S-30)
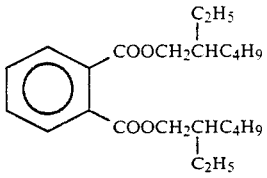
(S-31)
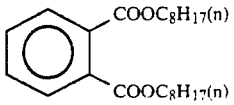
(S-32)
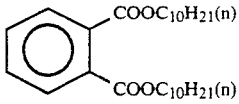
(S-33)
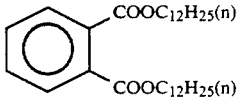
(S-34)
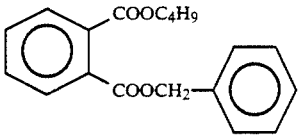
(S-35)
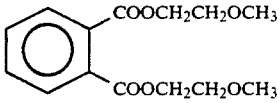
(S-36)
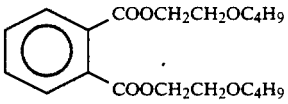
(S-37)
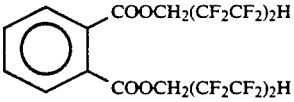
(S-38)
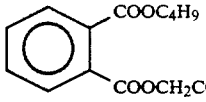
(S-39)
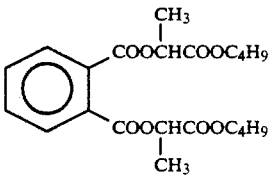
(S-40)
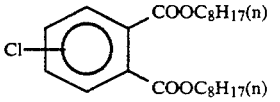
(S-41)
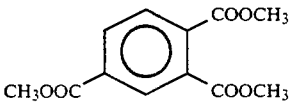
-continued
(S-42)
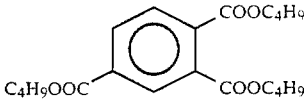
(S-43)
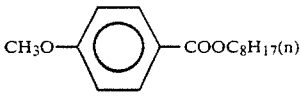
(S-44)
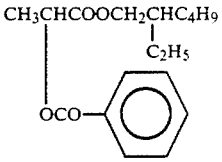
(S-45)
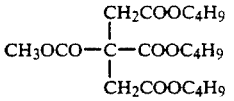
(S-46)
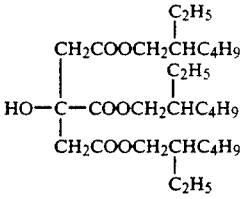
(S-47)
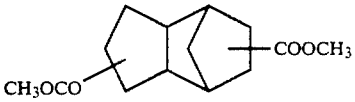
(S-48)
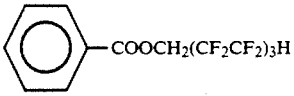
(S-49)
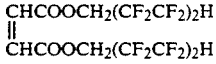
(S-50)
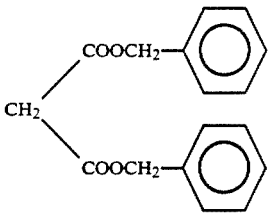
(S-51)
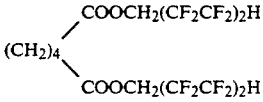
(S-52)
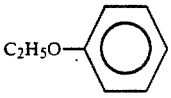
(S-53)
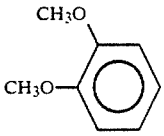

-continued

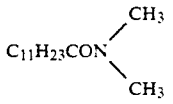

(S-54)

$C_{12}H_{25}OH$ (S-55)

$C_{16}H_{33}OH$ (S-56)

$C_{18}H_{37}OH$ (S-57)

$C_{10}H_{21}O(CH_2)_5O(CH_2)_2OH$ (S-58)

(S-59)

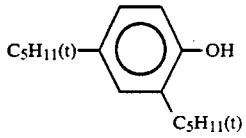

(S-60)

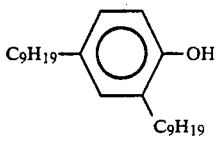

$CH_3(CH_2)_{17}Cl$ (S-61)

$CH_3(CH_2)_{15}Br$ (S-62)

(S-63)

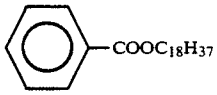

(S-64)

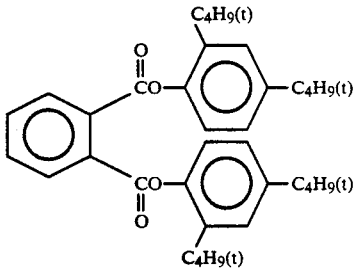

(S-64)

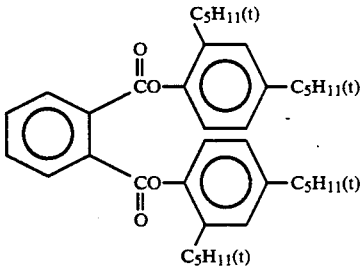

(S-66)

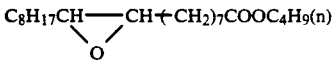

(S-67)

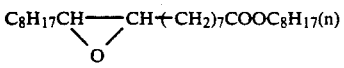

(S-68)

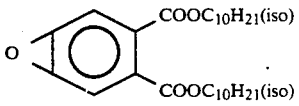

-continued

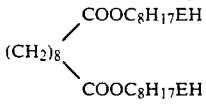

(S-69)

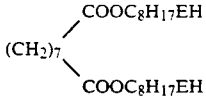

(S-70)

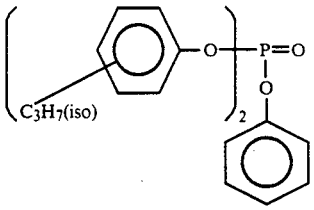

(S-71)

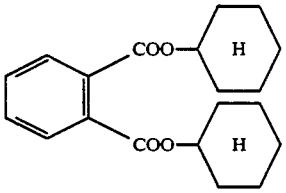

(S-72)

The oils of the present invention are used in a ratio of dye(g)/oil(g) of from 1/1000 to 1000, preferably from 1/100 to 100.

The dyes of formula (I) may be incorporated in a polymer latex and contained in the photographic materials. Preferred examples of polymers latexes include latexes of polyurethane polymers and polymers obtained by polymerizing vinyl monomers. Suitable vinyl monomers include acrylic esters (e.g., methyl acrylate, ethyl acrylate, butyl acrylate, hexyl acrylate, octyl acrylate, dodecyl acrylate, glycidyl acrylate), α-substituted acrylic esters (e.g., methyl methacrylate, butyl methacrylate, octyl methacrylate, glycidyl methacrylate), acrylamides (e.g., butyl acrylamide, hexyl acrylamide), α-substituted acrylamides (e.g., butyl methacrylamide, dibutyl methacrylamide), vinyl esters (e.g., vinyl acetate, vinyl butyrate), vinyl halides (e.g., vinyl chloride), vinylidene halides (e.g., vinylidene chloride), vinyl ethers (e.g., vinyl methyl ether, vinyl octyl ether), styrene, α-substituted styrenes (e.g., α-methylstyrene), nucleus-substituted styrene (e.g., hydroxystyrene, chlorostyrene, methylstyrene), ethylene, propylene, butylene, butadiene, acrylonitrile and the like. These monomers may be used either alone or in combinations of two or more of them. Other vinyl monomers may be used as comonomers. Examples of other vinyl monomers include itaconic acid, acrylic acid, methacrylic acid, hydroxyalkyl acrylates, hydroxyalkyl methacrylates, sulfoalkyl acrylates, sulfoalkyl methacrylates and styrenesulfonic acid.

These polymer latexes loaded with the dyes can be prepared according to the methods described in JP-B-51-39853 (the term "JP-B" as used herein means an "examined Japanese patent publication"), JP-A-51-59943, JP-A-53-137131, JP-A-54-32552, JP-A-54-107941, JP-A-55-133465, JP-A-56-19043, JP A-56-19047, JP-A-56-126830 and JP-A-58-149038.

The dyes are used in a ratio of the dye/polymer latex of from 10 to 1/10 by weight.

In the present invention, dye in the form of fine crystalline grains may be used, if the amount thereof is small. The amount of the dye in the form of crystalline grains is preferably not more than 230 mg/m$^2$ per side of the photographic material. This is because if such a small amount of the dye is used, continuous production can be accomplished while the material which causes surface artifact is removed by the use of a filter without a significant clogging problem occurring. Further, light is scattered by the fine crystalline grains and absorbed by dye other than the fin crystalline dye. Hence, the light absorbing effect can be enhanced.

As the fine crystalline dye, there can be used the compounds and dispersion methods described in European Patent Laid-Open Nos. 276566A1, 274723A1 and 299435A2, WO 88/04794, JP-A-55-155351, JP-A-56-12639, JP-A-55-155350, JP-A-59-92716, JP-A-55-25079, JP A-63-27838 and U.S. Pat. No. 4,276,373.

The dyes of formula (I) useful in the present invention can be used in a sufficient amount to filter or absorb light. It is particularly advantageous that the dyes of formula (I) be used in such an amount and at such a stage that they are solubilized during development and washed off. Only small amounts of the dyes are used when a small amount of light is to be absorbed, while when a larger amount of light is to be absorbed, larger amounts of the dyes of formula (I) can be used, so long as the colored level is left behind on a level which can be accepted by specific photographic elements. It is preferred that the dyes be present in an amount of from 11 to 11,111 mg/m$^2$.

Any of the conventional methods and processing solutions used for black-and-white photographic processing as described in, for example *Research Disclosure,* No. 176 (pages 28 to 30) (RD-17643), can be applied to the photographic materials of the present invention. Processing temperature is generally from 18° to 50° C. If desired, a temperature lower than 18° C. or higher than 50° C. may be used. However, processing at a temperature of 20° to 40° C. with an automatic processor is preferred in the present invention. Processing time (time taken until the dried photographic materials are discharged after the introduction thereof into the processor) is preferably from 20 seconds to 5 minutes. Processing time from 45 seconds to 3.5 minutes is particularly preferred.

Developing solutions used for black-and-white photographic processing may contain conventional developing agents. Examples of the developing agents include dihydroxybenzenes (e.g., hydroquinone), 3-pyrazolidones (e.g., 1-phenyl-3-pyrazolidone) and aminophenols (e.g., N-methyl-p-aminophenol). These compounds may be used either alone or in combination. Generally, the developing solutions contain conventional preservatives, alkaline agents, pH buffering agents and anti-fogging agents. If desired, the developing solutions may contain dissolution aids, color toning agents, development accelerators (e.g., quaternary salts, hydrazine, benzyl alcohol), restrainers (e.g., iodide, bromide, merapto compounds, triazole), surfactants, anti-foaming agents, water softeners, hardening agents (e.g., glutaraldehyde) and tackifiers.

For purposes of development, there may be used a method wherein the developing agent is incorporated in the photographic material, for example, in the emulsion layers, and the photographic material is processed in an aqueous alkaline solution to carry out development. Among the developing agents, hydrophobic agents can be incorporated in the emulsion layers by various methods described in *Research Disclosure,* No. 169 (RD-16928), U.S. Pat. No. 2,739,890, U.K. Patent 813,253 or West German Patent 1,547,763. Such development may be carried out in combination with a silver salt-stabilizing treatment using thiocyanates.

Fixing solutions having conventional compositions can be used in the present invention. Examples of fixing agents include thiosulfates and thiocyanates. In addition thereto, there can be used organosulfur compounds known as compounds having an effect as fixing agents. The fixing solutions may contain water-soluble aluminum salts as a hardening agent.

When compounds releasing restrainers during development as described in JP-A-61-230135 and JP-A-63-25653 are used, effects obtained by the present invention can be enhanced.

Any of silver chlorobromide, silver bromide, silver iodobromide and silver chloroiodobromide can be used as silver halide in the sensitive silver halide emulsions of the present invention. Silver iodobromide is preferred. The amount of silver iodide is preferably not higher than 30 mol %, particularly preferably not higher than 10 mol %. The distribution of iodine in silver iodobromide grains may be uniform or different between the interior and the surface of the grain. The mean grain size is preferably not smaller than 0.4 μm, particularly preferably 0.5 to 2.0 μm. Grain size distribution may be narrow or wide.

The silver halide grains of the present invention may have a regular crystal form such as cubic octahedral, tetradecahedral or rhombic dodecahedral, an irregular crystal form such as spheric, tabular (plate form) or potato form or a composite form of these crystal forms. A mixture of grains having various crystal forms may be used. Tabular grains having a grain diameter at least 5 times the thickness of grain are preferred for use in the present invention (Details are described in *Research Disclosure,* Vol. 225, item 22534, pp. 20–58, January 1983, JP-A-58-127921 and JP-A-58-113926).

The sensitive silver halide emulsion of the present invention may be composed of a mixture of two or more silver halide emulsions. The emulsions to be mixed with each other may be different in grain size, halogen composition, sensitivity, etc. from each other. The sensitive emulsion may be used in admixture with a substantially non-sensitive emulsion (surface of interior may be fogged or not fogged). Alternatively, the sensitive layer and the non-sensitive layer may be separately used, as described, for example, in U.S. Pat. Nos. 2,996,382 and 3,397,987. For example, a spherical or potato-form sensitive emulsion and a sensitive silver halide emulsion composed of tabular grains having a grain diameter at least 5 times the thickness of the grain may be used in the same layer or different layers as described in JP-A-58-127921. When they are used in different layers, the sensitive silver halide emulsion composed of tbular grains may be positioned nearer to the support or may be away farther from the support than the other emulsion.

The photographic emulsions of the present invention can be prepared according to the methods described in P. Glafkides, *Chimie et Physique Photographique* (Paul Montel, 1967), G. F. Duffin, *Photographic Emulsion Chemistry* (The Focal Press, 1966), V. L. Zelikman et al., *Making and Coating Photographic Emulsion* (The Focal Press, 1964), JP-A-58-127921 and JP-A-58-113926. Namely, any of the acid process, the neutral process and the ammonia process can be used. A soluble silver salt and a soluble halide salt can be reacted in accordance with the single jet process, the double jet process or a combination thereof.

A reverse mixing method in which silver halide grains are formed in the presence of excess silver ion can be used. A controlled double jet process in which a pAg value in a liquid phase wherein silver halide is formed is kept constant can also be used. According to this process, there can be obtained a silver halide emulsion wherein the crystal form is regular and the grain size is nearly uniform.

The crystal structure of the silver halide grains may be uniform throughout the whole of the grain. The interior of the grain and the exterior thereof may be in different laminar structures from each other. The crystal structure may be a conversion type as described in U.K. Patent 635,841 and U.S. Pat. No. 3,622,318. Cadmium salts, zinc salts, lead salts, thallium salts, iridium salts or complex salts thereof, rhodium salts or complex salts thereof, or iron salts or complex salts thereof may be allowed to coexist during the formation of the silver halide grains or during physical ripening.

Solvents for silver halide, such as ammonia, thioether compounds, thiazolidine-2-thione, tetra-substituted thioureas, potassium thiocyanate, ammonium thiocyanate and amine compounds may be present during the formation of the grains to control the growth of the grains.

The silver halide emulsions of the present invention may be subjected to chemical sensitization or may not be subjected to chemical sensitization. Examples of chemical sensitization include conventional sulfur sensitization, reduction sensitization and gold sensitization. These sensitization methods may be used either alone or in combination.

Among noble metal sensitization methods, gold sensitization is a typical method. Gold compounds, particularly gold complexes, may be used. In addition to gold complexes, complex salts of other noble metals such as platinum, palladium and iridium may be used. Examples thereof are described in U.S. Pat. No. 2,448,060 and U.K. Patent 618,061.

Examples of sulfur sensitizing agents include sulfur compounds contained in gelatin. In addition thereto, various sulfur compounds such as thiosulfates, thioureas, thiazoles and rhodanine can be used as sulfur sensitizing agents.

Examples of reduction sensitizing agents include stannous salts, amines, formamidinesulfinic acid and silane compounds.

The photographic emulsions of the present invention may contain various compounds to prevent fogging during the production, storage or processing of the photographic materials or to stabilize photographic performance. Examples of the compounds which are known as anti-fogging agents or stabilizers include azoles (e.g., benzthiazolium salts, nitroimidazoles, nitrobenzimidazoles, chlorobenzimidazoles, bromobenzimidazoles, nitroindazoles, benztriazoles, aminotriazoles); mercapto compounds (e.g., mercaptothiazoles, mercaptobenzthiazoles, mercaptobenzimidazoles, mercaptothiadiazoles, mercaptotetrazoles (particularly 1-phenyl-5-mercaptotetrazoles), mercaptopyrimidines, mercaptotriazines); thio-keto compounds such as oxazolinethione; azaindenes (e.g., triazaindenes, tetraazaindenes (particularly, 4 hydroxy-substituted (1,3,3a,7)-tetraazaindenes), pentaazaindenes); and benzenethiosulfonic acid, benzenesulfinic acid and benzenesulfonamide.

Particularly preferred examples of the compounds are nitron and derivatives described in JP-A-60-76743 and JP-A-60-87322; mercapto compounds described in JP-A-60-80839; and heterocyclic compounds and complex salts of heterocyclic compounds with silver (e.g., 1-phenyl-5-mercaptotetrazolesilver).

The sensitive silver halide emulsions of the present invention may be spectrally-sensitized to relatively long wave length blue light, green light, red light or infrared light by using spectral sensitizing agents. Examples of the sensitizing dyes include cyanine dyes, merocyanine dyes, complex cyanine dyes, complex merocyanine dyes, holopolar cyanine dyes, styryl dyes, hemicyanine dyes, oxonol dyes and hemioxonol dyes.

The sensitizing agents may be added at any stage during the course of the manufacturing process of the photographic emulsions or at any stage immediately before coating after the production of the emulsions. In the former case, the agents are added during the formation of silver halide grains, physical ripening or chemical ripening.

The photographic emulsion layers or other hydrophilic colloid layers of the photographic materials of the present invention may contain various surfactants as coating aids or for the purpose of imparting antistatic properties, improving slipperiness, inhibiting adhesion improving emulsifying dispersion and photographic characteristics (e.g., development acceleration, high contrast, sensitization) or preventing sticking from being caused.

Examples of the surfactants include nonionic surfactants such as saponin (steroid), alkylene oxide derivatives (e.g., polyethylene glycol, polyethylene glycol/polypropylene glycol condensate, polyethylene glycol alkyl ethers, polyethylene alkyl aryl ethers, polyethylene oxide adducts of silicone) and alkyl ethers of saccharide; anionic surfactants such as alkylsulfonates, alkylbenzenesulfonate, alkylnaphthalenesulfonates, alkylsulfuric esters, N-acyl-N-alkyltaurines, sulfosuccinic esters and sulfoalkylpoloxyethylene alkyl phenyl ethers; ampholytic surfactants such as alkylsulfobetaines; and cationic surfactants such as aliphatic or aromatic quaternary ammonium salts, pyridinium salts and imidazolium salts. Among them, there are particularly preferred saponin, anions such as the Na salt of dodecylbenzenesulfonic acid, the Na salt of di-2-ethylhexyl α-sulfosuccinate, the Na salt of p-octylphenoxyethoxyethoxyethanesulfonic acid, the Na salt of dodecylsulfuric acid, the Na salt of triisopropylnaphthalenesulfonic acid and the Na salt of N-methyl-oleoyltaurine; cations such as dodecyltrimethylammonium chloride, N-oleoyl-N',N',N'-trimethylammoniodiaminopropane bromide and dodecylpyridium chloride; betaines such as N-dodecyl-N,N-dimethylcarboxybetaine and N-oleyl-N,N-dimethylsulfobutylbetaine; and nonions such as poly(average polymerization degree (n=10))oxyethylene cetyl ether, poly(n=25)oxyethylene p-nonylphenol ether and bis(1poly(n=15)oxyethylene-oxy-2,4-di-pentylphenyl)ethane.

As antistatic agents, there are preferred fluorine-containing surfactants such as the K salt of perfluorooctanesulfonic acid, the Na salt of N-propyl-N-perfluorooctane sulfonylglycine, the Na salt of N-propyl-N-perfluorooctanesulfonylaminoethyloxypoly(n=3) oxyethylenebutanesulfonic acid, N perfluorooctanesulfonyl-N',N',N'-trimethylammoniodiaminopropane chloride and N-perfluorodecanoylaminopropyl-N',N'-dimethyl-N'-carboxybetaine, nonionic surfactants described in JP-A-60-80848, JP-A-61-112144, JP-A-62-172343 and JP-A-62-173459, alkali metal nitrates, electrically conductive tin oxide, zinc oxide, vanadium pentoxide and their composite oxides doped with antimony, etc.

Examples of matting agents which can be used in the present invention include organic compounds such as homopolymers (e.g., polymethyl methacrylate), copolymers (e.g., copolymer of methyl methacrylate with methacrylic acid) and starch, and fine particles of inorganic compounds such as silica and titanium dioxide. The particle size thereof is preferably 1.0 to 10 μm, particularly preferably 2 to 5 μm.

The surface layers of the photographic materials of the present invention may contain slip agents such as the silicone compounds described in U.S. Pat. Nos. 3,489,576 and 4,047,958, colloidal silica as described in JP-B-56-23139, paraffin wax, higher fatty acid esters and starch derivatives.

The hydrophilic colloid layers of the photographic materials of the present invention may contain, as plasticizers, polyols such as trimethylol propane, pentanediol, butanediol, ethylene glycol and glycerine. Further, it is preferred that a polymer latex be incorporated in the hydrophilic colloid layers of the photographic materials of the present invention to improve pressure resistance. Preferred examples of such polymers include homopolymers of alkyl acrylates, copolymers of alkyl acrylates with acrylic acid, styrene/butadiene copolymers and polymers or copolymers of monomers having an active methylene group.

The photographic emulsion layers and non-photosensitive hydrophilic colloid layers of the present invention may contain inorganic or organic hardening agents. Preferred examples of the hardening agents include chromium salts, aldehydes (e.g., formaldehyde, glutaraldehyde), N-methylol compounds (e.g., dimethylol urea), active vinyl compounds (e.g., 1,3,5-triacryloyl-hexahydro-s-triazine, bis(vinylsulfonyl)methyl ether, N,N'-methylenebis[β-(vinylsulfonyl)propionamide], active halogen compounds (e.g., 2,4-dichloro-6-hydroxy-s-triazine), mucohalogenic acids (e.g., mucochloric acid), N-carbamoylpyridinium salts (e.g., (1-morpholinocarbonyl-3-pyridinio)methanesulfonate and haloamidinium salts (e.g., (1-(1-chloro-1-pyridinomethylene)pyrrolidinium 2-naphthalenesulfonate). These compounds may be used either alone or in combination. Among them, there are preferred the active vinyl compounds described in JP-A-53-41220, JP-A-53-57257, JP-A-59-162546 and JP-A-60-80846 and the active halogen compounds described in U.S. Pat. No. 3,325,287.

When the photographic materials of the present invention are used as X-ray photographic materials, it is preferred that the hydrophilic colloid layers be hardened with these hardening agents to such an extent as to give a swelling ratio of not higher than 200%, particularly not higher than 150% in water.

Gelatin is advantageously used as a binder or protective colloid for use in the emulsion layers or interlayers of the photographic materials of the present invention. However, other hydrophilic colloids can be used. For example, synthetic hydrophilic high-molecular materials such as dextran, polyvinyl alcohol, polyvinyl alcohol partial acetal, poly-N-vinylpyrrolidone, polyacrylic acid, polyacrylamide and polyvinylimidazole and copolymers thereof can be used.

Examples of gelatin include lime-processed gelatin, acid-processed gelatin and enzyme processed gelatin. Hydrolyzate of gelatin can also be used.

It is preferred to use gelatin together with dextran and polyacrylamide.

Development can be carried out by referring to the above-described *Research Disclosure*, Vol. 176, item 7643, pp 28–30.

The present invention is now illustrated in greater detail by reference to the following examples which, however, are not to be construed as limiting the invention in any way. Unless otherwise indicated, all parts, percents and ratios are by weight.

EXAMPLE 1

A biaxially stretched polyethylene terephthalate film of 175 μm in thickness was subjected to corona discharge treatment and was coated with the following first subbing solution having the following composition by means of a wire bar coater in such an amount as to give a coating weight of 5.1 cc/m$^2$. The coated film was dried at 175° C. for one minute. In the same way as in the above coating, an opposite side thereof was coated with the first subbing solution to form a first subbing layer.

| | |
|---|---|
| Butadiene-styrene copolymer latex solution (solid: 40%, butadiene/styrene = 31/69) | 79 cc |
| 4% solution of sodium salt of 2,4-dichloro-6-hydroxy-s-triazine | 20.5 cc |
| Distilled water | 900.5 cc |

The latex solution contained 0.4 wt % (based on the amount, on a solid basis, of latex) of a compound represented by the following formula as an emulsifying dispersant.

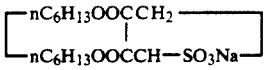

Both sides of the film having the first subbing layer were coated with the following second subbing solution having the following composition in such an amount as to give a coating weight of 8.5 cc/m$^2$ per side. The coated product (both sides being coated) was dried to obtain a film having subbing layers.

| | |
|---|---|
| Gelatin | 30 g |
| Oil indicated in Table 1 | |
| Dye indicated in Table 1 | |
| 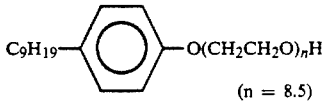 (n = 8.5) | 0.2 g |
| Matting agent (polymethyl methacrylate having an average particle size of 2.5 μm) | 0.3 g |
| 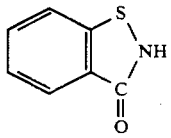 | 0.035 g |

-continued

| | |
|---|---|
| $H_2O$ | to make 1 liter |

PREPARATION OF COATING SOLUTION FOR EMULSION LAYER 5 g of potassium bromide, 0.05 g of potassium iodide, 30 g of gelatin and 2.5 cc of a 5% aqueous solution of thioether $HO(CH_2)_2S(CH_2)_2S(CH_2)_2OH$ were added to 1 liter of water. To the resulting solution kept at 73° C. with stirring, there were added an aqueous solution of 8.33 g of silver nitrate and an aqueous solution containing 5.94 g of potassium bromide and 0.726 g of potassium iodide over a period of 45 seconds by a double jet process. Subsequently, 2.5 g of potassium bromide was added thereto. Further, an aqueous solution containing 8.33 g of silver nitrate was added thereto over a period of 7.5 minutes at such a rate that the flow rate at the time of the completion of the addition was twice that at the time of the commencement of the addition. Subsequently, an aqueous solution of 153.34 g of silver nitrate and an aqueous solution of a mixture of potassium bromide and potassium iodide were added thereto over a period of 25 minutes by a controlled double jet process while keeping the potential at a pAg of 8.1. The addition was made at such an accelerating rate that the flow rate at the time of the completion of the addition was 8 times that at the time of the commencement of the addition. After the completion of the addition, 15 cc of 2N potassium thiocyanate solution was added thereto. Further, 50 cc of a 1% aqueous solution of potassium iodide was added thereto over a period of 30 seconds. The temperature of the mixture was lowered to 35° C. and soluble salts were removed by a precipitation method. The temperature was raised to 40° C. 6 g of gelatin, 2 g of phenol and 7.5 g of trimethylol propane were added thereto. The pH of the mixture was adjusted to 6.55 and the pAg was adjusted to 8.10 by using caustic soda and potassium bromide.

After the temperature was raised to 56° C., 175 mg of 4-hydroxy-6-methyl-1,3,3a,7-tetraazaindene and 625 mg of the following sensitizing dye were added thereto. After 10 minutes, 5.5 mg of sodium thiosulfate pentahydrate, 163 mg of potassium thiocyanate and 3.6 mg of chloroauric acid were added thereto. After 5 minutes, the mixture was quenched to solidify it. The resulting emulsion was composed of grains having such a grain size distribution that rains having an aspect ratio of not lower than 3 accounted for 93% of the sum total of the projected area of the entire grains. With regard to all grains having an aspect ratio of not lower than 2, the average diameter of projected areas was 0.95 μm, standard deviation was 23%, average thickness was 0.155 μm and aspect ratio was 6.1.

Sensitizing Dye

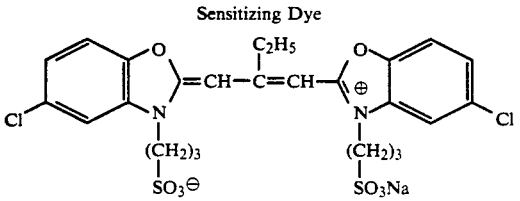

The following reagents were added to the emulsion to prepare a coating solution, each amount being per mol of silver halide.

| | |
|---|---|
| 2,6-Bis(hydroxyamino)-4-diethylamino-1,3,5-triazine | 80 mg |
| Polysodium acrylate (average molecular weight: 41,000) | 4.0 g |
| 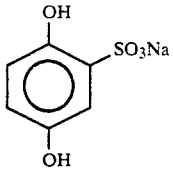 | 9.7 g |
| Ethyl acrylate/acrylic acid/methacrylic acid (95/2/3) copolymer plasticizer | 20.0 g |
| Nitron | 50 mg |
| 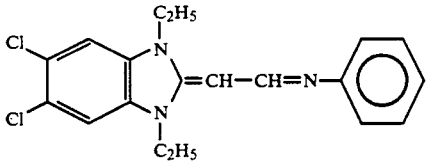 | 5.0 mg |

Both sides of the support prepared as described above were coated with the thus prepared coating solution for the emulsion layer and a coating solution for the surface protective layer in the same manner by means of a co-extrusion method. The coating weights of the emulsion layer and the surface protective layer per one side were the following amounts:

| | |
|---|---|
| Emulsion Layer | |
| Coated silver amount | 1.9 g/m² |
| Coated gelatin amount | 1.5 g/m² |
| Surface Protective Layer | |
| Gelatin | 0.81 g/m² |
| Dextran (average molecular weight: 39,000) | 0.81 g/m² |
| Matting agent (polymethyl methacrylate/methacrylic acid (9/1) copolymer, average particle size: 3.5 μm) | 0.06 g/m² |
| $C_8H_{17}$—⟨○⟩—$O(CH_2CH_2O)_{10}(CH_2CH(OH)CH_2O)_3H$ | 60 mg/m² |
| $C_8H_{17}$—⟨○⟩—$O(CH_2CH_2O)_2CH_2CH_2SO_2Na$ | 20 mg/m² |
| $C_8F_{17}SO_2N(C_3H_7)(CH_2CH_2O)_4(CH_2)_4SO_3Na$ | 2 mg/m² |
| $C_8F_{17}SO_2N(C_3H_7)(CH_2CH_2O)_{15}H$ | 5 mg/m² |
| 4-Hydroxy-6-methyl-1,3,3a,7-tetraazaindene | 15.5 mg/m² |
| Sodium polyacrylate (average molecular weight: 41,000) | 70 mg/m² |

1,2-Bis(sulfonylacetaido)ethane as a hardening agent was coated in such an amount as to give a coating weight of 56 mg/m² per side. In this way, the photographic material of the present invention was prepared.

EVALUATION OF PHOTOGRAPHIC PERFORMANCE

GRENEX ortho-screen HR-4 (manufactured by Fuji Photo Film Co., Ltd.) was brought into close contact with both sides of the photographic material by using a cassette. X-ray sensitometry was carried out. The adjustment of exposure amount was made by changing the distance between the X-ray tube and the cassette. After exposure, the photographic material was processed by using the following developing solution and fixing solution in an automatic processor.

MEASUREMENT OF SHARPNESS, MODURATION TRANSFER FUNCTION (MTF)

MTF was measured by combining the above-described HR-4 screen with processing by an automatic processor. Measurement was made by an aperture of 30 μm×500 μm. Evaluation was made at an optical density of 1.0 using MTF value at a spatial frequency of 1.0 cycle/mm.

MEASUREMENT OF RESIDUAL DYE

Unexposed film was subjected to the above-described processing in an automatic processor. Subsequently, the green-transmitted density was measured through a Macbeth status A filter. The green-transmitted density of a non-subbed blue polyethylene terephthalate support was also measured. The net value obtained by subtraction was referred to as the residual dye density value. Evaluation was made on the basis of this value.

EVALUATION OF CROSS-OVER

GRENEX ortho-screen HR-4 (manufactured by Fuji Photo Film Co., Ltd.) was brought into close contact with one side of the sample by using a cassette. X-ray sensitometry was carried out. The sample was processed in the same way as in the evaluation of photographic performance. The value of cross-over was calculated from the following formula by using the difference in sensitivity (log E) between the surface (front surface) contacted with the screen and the other surface (back surface).

$$\% = \frac{1}{\text{anti log}\,(\Delta\log E) + 1} \times 100$$

EVALUATION OF SURFACE PROFILE

The surface profile of the sample was confirmed by using a loupe (ten times magnification).

○: No problem.

×: Three or more agglomerates per $m^2$ were observed.

| | |
|---|---|
| Development | 35° C. × 9.5 sec |
| Fixing | 31° C. × 10 sec |
| Rinse | 15° C. × 6 sec |
| Squeeze | 6 sec |
| Drying | 50° C. × 12 sec |
| Dry to Dry processing time | 45 sec |

The developing solution and fixing solution had the following composition:

| Developing Solution | |
|---|---|
| Potassium hydroxide | 29 g |
| Potassium sulfite | 44.2 g |
| Sodium hydrogencarbonate | 7.5 g |
| Boric acid | 1.0 g |
| Diethylene glycol | 12 g |
| Ethylenediaminetetraacetic acid | 1.7 g |
| 5-Methylbenztriazole | 0.06 g |
| Hydroquinone | 25 g |
| Glacial acetic acid | 18 g |
| Triethylene glycol | 12 g |
| 5-Nitroindazole | 0.25 g |
| 1-Phenyl-3-pyrazolidone | 2.8 g |
| Glutaraldehyde (50 wt/wt %) | 9.86 g |
| Sodium metabisulfite | 12.6 g |
| Potassium bromide | 3.7 g |
| Add water | to make 1.0 liter |
| Fixing Solution | |
| Ammonium thiosulfate (70 wt/vol %) | 200 ml |
| Disodium ethylenediaminetetraacetate dihydrate | 0.02 g |
| Sodium sulfite | 15 g |
| Boric acid | 10 g |
| Sodium hydroxide | 6.7 g |
| Glacial acetic acid | 15 g |
| Aluminum sulfate | 10 g |
| Sulfuric acid (36N) | 3.9 g |
| Add water | to make 1.0 liter |
| pH was adjusted to | 4.25 |

TABLE 1

| Sample | Oil ($mg/m^2$) | Dye ($mg/m^2$) | Surface Profile | Cross-over (%) | MTF |
|---|---|---|---|---|---|
| 1 (Comp. Ex.) | — | — | ○ | 30 | 0.42 |
| 2 (Comp. Ex.) | — | — | ○ | 30 | 0.42 |
| 3 (Comp. Ex.) | — | Type-1 (250) | × | 10 | 0.56 |
| 4 (Comp. Ex.) | — | Type-1 (400) | × | 3 | 0.59 |
| 5 (Comp. Ex.) | S-13 (430) | — | ○ | 30 | 0.42 |
| 6 (Invention) | S-13 (270) | Dye I-23 (270) | ○ | 10 | 0.56 |
| 7 (Invention) | S-13 (430) | Dye I-23 (430) | ○ | 3 | 0.59 |

****

The dye of Type 1 which was used in Samples 3 and 4 was dispersed in a ball mill for 6 hours before use.

Type-1

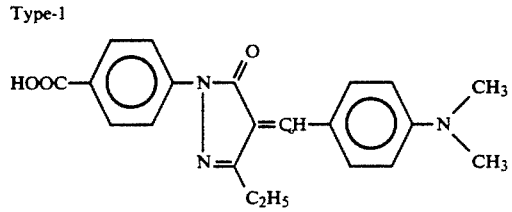

In Samples 5, 6 and 7, an oil dispersion was prepared by using the following formulation:

| Solution I | | |
|---|---|---|
| Gelatin | 10 g | |
| $H_2O$ | 50 | |
| Citric acid | 0.07 | |
| Solution II | Sample 5 | Sample 6 & 7 |
| Dye I-23 | — | 2 g |
| S-13 | 2 g | 2 g |
| Ethyl acetate | 25 g | 25 g |

-continued

| | | |
|---|---|---|
| Surfactant | 1 g | 1 g |

Surfactant

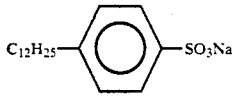

Solution II was added to Solution I with vigorous stirring.

It is apparent from Table I that Samples 6 and 7 of the present invention enable cross-over to be reduced without causing surface artifact.

EXAMPLE 2

A biaxially stretched polyethylene terephthalate film of 175 μm in thickness was subjected to a corona discharge treatment and was coated with the following first subbing solution having the following composition by means of wire bar coater in such an amount as to give a coating weight of 5.1 cc/m$^2$. The coated film was dried at 175° C. for one minute. In the same way as the above coating, the other side of the film was coated with the first subbing solution to form a first subbing layer.

| | |
|---|---|
| Butadiene-styrene copolymer latex solution (solid: 40%, butadiene/styrene = 31/69 by weight) | 79 cc |
| 4% solution of sodium salt of 2,4-dichloro-6-hydroxy-s-triazine | 20.5 cc |
| Distilled water | 900.5 cc |

The latex solution contained 0.4 wt % (based on the amount, on a solid basis, of latex) of a composition represented by the following formula as an emulsifying dispersant;

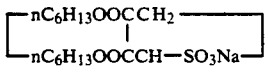

Both sides of the film having the first subbing layer were coated with the following second subbing solution having the following composition in such an amount as to give a coating weight of 8.5 cc/m$^2$ per side. The coated product (both sides being coated) was drid to obtain a film having subbing layers.

| | |
|---|---|
| Gelatin | 30 g |
| 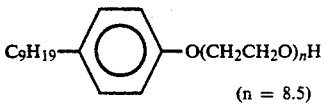 (n = 8.5) | 0.2 g |
| Matting agent (polymethyl methacrylate having an average particle size of 2.5 μm) | 0.3 g |
| 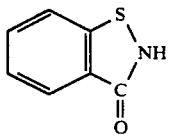 | 0.035 g |
| $H_2O$ | to make 1 liter |

PREPARATION OF COATING SOLUTION FOR EMULSION LAYER

The emulsion was prepared in the same way as in Example 1.

The following reagents were added to the emulsion to prepare a coating solution, each amount being per mol of silver halide.

| | |
|---|---|
| 2,6-Bis(hydroxyamino)-4-diethylamino-1,3,5-triazine | 80 mg |
| Polysodium acrylate (average molecular weight: 41,000) | 4.0 g |
| 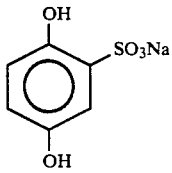 | 9.7 g |

The coated weights of the dye layer, the emulsion layer and the surface protective layer per side were the following amounts:

| | |
|---|---|
| Dye Layer | |
| Coated gelatin amount | 0.5 g/m$^2$ |
| Dye indicated in Table II | |
| Emulsion Layer | |
| Coated silver amount | 1.9 g/m$^2$ |
| Coated gelatin amount | 1.5 g/m$^2$ |
| Surface Protective Layer | |
| Gelatin | 0.81 g/m$^2$ |
| Dextran (average molecular weight: 39,000) | 0.81 g/m$^2$ |
| Matting agent (polymethyl methacrylate/methacrylic acid (9/1) copolymer, average particle size: 3.5 μm) | 0.06 g/m$^2$ |
| 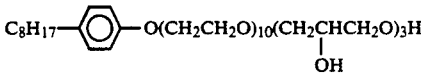 | 60 mg/m$^2$ |
| 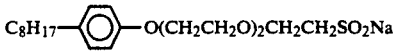 | 20 mg/m$^2$ |
| $C_8F_{17}SO_2N(C_3H_7)(CH_2CH_2O)_4(CH_2)_4SO_3Na$ | 2 mg/m$^2$ |
| $C_8F_{17}SO_2N(C_3H_7)(CH_2CH_2O)_{15}H$ | 5 mg/m$^2$ |
| 4-Hydroxy-6-methyl-1,3,3a,7-tetraazaindene | 15.5 mg/m$^2$ |
| Sodium polyacrylate (average molecular weight: 41,000) | 70 mg/m$^2$ |

1,2-Bis(sulfonylacetaido)ethane as a hardening agent was coated in such an amount as to give a coating weight of 56 mg/m$^2$ per side. In this way, the photographic material of the present invention was prepared. Evaluation was made in the same way as in Example 1.

The results are shown in Table 2.

TABLE 2

| Sample | Oil (mg/m²) | Polymer (mg/m²) | Dye (mg/m²) | Surface Profile | Crossover (%) | MTF |
|---|---|---|---|---|---|---|
| 8 | — | — | — | ◎ | 30 | 0.42 |
| 9 | — | — | Type-1 (250) | × | 10 | 0.55 |
| 10 | S-13 (270) | — | Dye I-23 (270) | ◎ | 10 | 0.55 |
| 11 | — | Polyethylacrylate (270) | Dye I-23 (270) | ◎ | 10 | 0.55 |
| 12 | S-13 (135) | Polyethylacrylate (135) | Dye I-23 (135) | ◎ | 10 | 0.55 |

The dye of Type 1 which was used in Example 9 was dispersed in a ball mill for 6 hours before use.

In Samples 10, 11 and 12, an oil dispersion was prepared by using the following formulation:

| Solution I | | | |
|---|---|---|---|
| Gelatin | 10 g | | |
| $H_2O$ | 50 | | |
| Citric acid | 0.07 | | |
| Solution II | Sample | | |
| | 10 | 11 | 12 |
| Dye I-23 | 2 g | 2 g | 2 g |
| S-13 | 2 g | — | 1 g |
| Polymethylmethacrylate | — | 2 g | 2 g |
| Ethyl acetate | 25 g | 25 g | 25 g |
| Surfactant | 1 g | 1 g | 1 g |

Surfactant

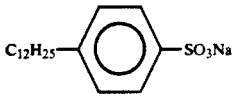

Solution II was added to Solution I with vigorous stirring.

It is apparent from Table 2 that the samples of the present invention enable cross-over to be reduced without causing surface artifact.

EXAMPLE 3

Samples were prepared in the same way as in Example 2 except that the compositions of the dye layers were changed to those given in Table 3. Tests were made in the same way as in Example 2.

TABLE 3

| Sample | Polymer (mg/m²) | Dye (mg/m²) | Crystalline Dye (mg/m²) | Surface Profile with Filter | Crossover (%) | (Δlog E) |
|---|---|---|---|---|---|---|
| 13 | Polymethyl methacrylate (270) | Dye I-23 (270) | — | ◎ | 10 | 0.95 |
| 14 | Polymethyl methacrylate (135) | Dye I-23 (135) | — | ◎ | 17 | 0.69 |
| 15 | Polymethyl methacrylate (135) | Dye I-23 (135) | Type-1 (100) | ◎ | 4.3 | 1.35 |
| 16 | Polymethyl methacrylate (135) | Dye I-23 (135) | Type-1 (200) | ◎ | 2 | 1.69 |
| 17 | — | — | Type-1 (100) | ◎ | 21 | 0.58 |
| 18 | — | — | Type-1 (200) | ◎ | 12.5 | 0.85 |

It is apparent that when the dye dispersed in the polymer is used together with the crystalline dye, the effect of reducing cross-over is greater than when the dye dispersed in the polymer is used alone, as evidenced in the value for Δlog E. Further, it will be understood that surface profile can be maintained by the use of a filter even when the crystalline dye is used.

While the invention has been described in detail and with reference to specific embodiments thereof, it will be apparent to one skilled in the art that various changes and modifications can be made therein without departing from the spirit and scope thereof.

What is claimed is:

1. An X-ray photographic material having:

(1) at least one sensitive silver halide photographic emulsion layer provided on both sides of a support; and (2) at least one dye-fixing layer provided on at least one side of the support for fixing a dye which can be decolorized during development and which absorbs light in the sensitive region of the photographic material and wherein:

(3) the dye is incorporated in the dye-fixing layer and contributes to the reduction of cross-over to less than 10%; and (4) the dye is a compound selected from the group consisting of compounds represented by the following general formula (I) and is dissolved in an oil which is a solvent substantially insoluble in water and having a boiling point of not lower than 160° C. and which is dispersed as oil droplets or is loaded and dispersed in a polymer latex:

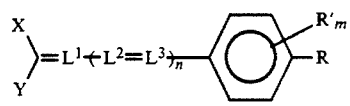

(I)

wherein X and Y each represents a substituent group, or X and Y may be combined together to form a heterocyclic group; $L^1$, $L^2$ and $L^3$ each represents a methine group; R and R' each represents a hydrogen atom or a substituent group; m represents an integer of from 1 to 4; and n represents 0 or 1.

2. The X-ray photographic material of claim 1, wherein X and Y are each of a cyano group, a carboxy group, an alkylcarbonyl group, an arylcarbonyl group, an alkoxycarbonyl group, an aryloxycarbonyl group, a carbamoyl group, a sulfonyl group, a sulfamoyl group, or X and Y may be combined together to form a 5-membered heterocyclic group or a 6-membered heterocyclic group; $L^1$, $L^2$ and $L^3$ are each an unsubstituted or substituted methine group; R is a hydrogen atom, a hydroxyl group, an alkoxy group, a phenoxy group, or an amino group; R' is a hydrogen atom, an alkyl group, an aryl group, a halogen atom, a hydroxyl group, a cyano group, a nitro group, an alkoxy group, an amino group, a carbamoyl group, or a sulfamoyl group; m is an integer of 1 to 4; and n is 0 or 1.

3. The X-ray photographic material of claim 1, wherein the dye is

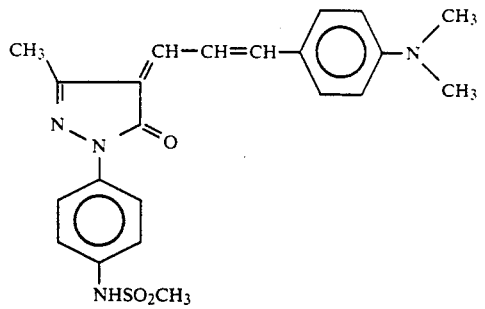

4. The X-ray photographic material of claim 1, wherein the dye is dispersed in the oil and the polymer latex.

5. The X-ray photographic material of claim 1, further comprising a dye in the form of crystalline grains in an amount less than 230 mg/m$^2$ per side of the photographic material.

* * * * *